US008651971B1

(12) United States Patent
Chen

(10) Patent No.: US 8,651,971 B1
(45) Date of Patent: Feb. 18, 2014

(54) SWING TAG GAME

(71) Applicant: Samuel Chen, Kowloon (CN)

(72) Inventor: Samuel Chen, Kowloon (CN)

( * ) Notice: Subject to any disclaimer, the term of this patent is extended or adjusted under 35 U.S.C. 154(b) by 0 days.

(21) Appl. No.: 13/711,989

(22) Filed: Dec. 12, 2012

(51) Int. Cl.
*A63G 9/12* (2006.01)

(52) U.S. Cl.
USPC ..... 472/118; 472/128; 273/310

(58) Field of Classification Search
USPC ..... 473/615; 472/118, 128; 463/25–31; 273/310
See application file for complete search history.

(56) References Cited

U.S. PATENT DOCUMENTS

2012/0083348 A1* 4/2012 Burgaard et al. ..... 472/118
2013/0045813 A1* 2/2013 Publicover et al. ..... 472/118
2013/0143701 A1* 6/2013 Chen ..... 473/615

* cited by examiner

*Primary Examiner* — Masud Ahmed
(74) *Attorney, Agent, or Firm* — Clement Cheng

(57) ABSTRACT

A swing tag game has: a first swing support supporting a first seat for a first player; a middle module comprising a middle module emitter and a middle module receiver; first player inputs including a first player middle module first control corresponding to an attack; a second swing support supporting a second seat for a second player; second player inputs including a second player middle module first control corresponding to an attack; an attack defense resolution; and an indication output such as lights, sound or vibration. The middle module can be formed as a glove gun. The middle module can be formed as a sleeve and the middle module can be for indicating a successful hit.

19 Claims, 5 Drawing Sheets

SWING TAG GAME

FIELD OF THE INVENTION

The present invention is in the field of play swing games.

DISCUSSION OF RELATED ART

Children have played on swing sets for centuries. A variety of play swing games have been created to modify the basic swing activity so as to have an additional gameplay while swinging.

Interactive play has included games such as adding water and water balloons as described in United States patent application publication 2005/0049055 to Publicover published Mar. 3, 2005. Publicover describes a play swing with safety harness and water targets and water soaking apparatus.

A variety of different electronic infrared tag games have been devised where the goal is to tag specified targets by shooting at targets using an infrared-emitting targeting device. For example, in U.S. Pat. No. 6,302,796, issued Oct. 16, 2001, inventor Steven Lebensfeld et al. describes a tag playing device where each player is equipped with an IR emitter, IR detector, and an audio or visual device, the disclosure of which is incorporated herein by reference. In such a game, a player targets one another and shoots the other person with their infrared emitting device.

In United States Patent 2002/0111201, issued Aug. 15, 2002, inventor Brook W. Lang invents a laser tag game system in which every infrared emitting shot is recorded by a central computer device, the disclosure of which is incorporated herein by reference. In addition, the location of each player holding an infrared emitting device is logged into the central computer as well.

In United States Patent 2009/0005196, issued Jan. 1, 2009, inventor James J. Kessler et al. creates a game involving people on a game court in bumper vehicles, the disclosure of which is incorporated herein by reference. Added to this, he involves the idea of having a tag style game in such playing field.

In U.S. Pat. No. 7,846,028, issued Dec. 7, 2010, inventor David B. Small et al. describes a laser tag game where previous game play experience sessions are stored in its memory, the disclosure of which is incorporated herein by reference. With more stored experience, a player is allowed to advance in level, or in other words, their shooting mechanism will become upgraded with more capabilities.

SUMMARY OF THE INVENTION

A swing tag game has: a first swing support supporting a first seat for a first player; a middle module comprising a middle module emitter and a middle module receiver; first player inputs including a first player middle module first control corresponding to an attack; a second swing support supporting a second seat for a second player; second player inputs including a second player middle module first control corresponding to an attack; an attack defense resolution; and an indication output such as lights, sound or vibration. The middle module can be formed as a glove gun. The middle module can be formed as a sleeve and the middle module can be for indicating a successful hit.

The indication output may include a light and sound. The indication output includes a game score. An upper module has an upper module light for indicating a successful hit. A reticle is connected to the first swing support for providing a line of sight for aiming. A lower module has a lower module receiver.

The swing tag game may have a lower module light for indicating a successful hit. The swing tag game may also have a middle module second control. The middle module can be secured to the first swing support. The e middle module is formed as a glove gun. The middle module is formed as a sleeve for indicating a successful hit. The indication output includes a light and sound. The indication output includes a game score. The upper module light may provide an additional target. The reticle can be connected to the first swing support for providing a line of sight for aiming. The second swing support supports a second seat and player two inputs can be mounted to the second swing supports. The middle module is formed as a glove gun, and the indication output includes a light and sound. The indication output includes a game score and includes an upper module light for providing an additional target.

The following call out list of elements can be a useful guide in referencing the call out numbers of the drawings.

11 Swing Support
12 Swing Seat
13 First Player
14 Second Player
15 Ground
20 Middle Module
21 Middle Module Gun
22 Middle Module Sleeve Cavity
23 Middle Module Gun Cavity
24 Middle Module Gun Emitter
25 Middle Module Side Emitter
26 Middle Module Side Receiver
27 Middle Module First Control
28 Middle Module Second Control
29 Middle Module Control Face
31 Glove Gun
32 Glove
33 Finger Cavity Of Glove Gun
34 Glove Emitter
40 Lower Module
42 Lower Module Sleeve Cavity
45 Lower Module Side Emitter
46 Lower Module Side Receiver
47 Lower Module First Control
48 Lower Module Second Control
49 Lower Module Control Face
51 Swing Support Wiring
52 Swing Seat Wiring
152 Reticle
154 Line Of Sight

53 Upper Module Game Target
54 Upper Module Receiver Shield
55 Upper Module Receiver
56 Upper Module Light
57 Upper Module Display Indicator
58 Upper Module Opaque Layer
59 Upper Module Translucent Layer
88 Middle Attack Control
188 Middle Defense Control
288 Lower Attack Control
388 Lower Defense Control
888 Glove Trigger
101 Player One Input
102 Player One Attack
103 Player One Defense
201 Player Two Input
202 Player Two Attack
203 Player Two Defense
301 Attack Defense Resolution
400 Indication Output
401 Lights
402 Speakers
403 Vibration
404 Can Score
311 Rock
312 Paper
313 Scissor
314 High Stance
315 Low Stance
316 Dodge Stance
317 Ready Stance

DETAILED DESCRIPTION OF THE PREFERRED EMBODIMENT

Figure 1:
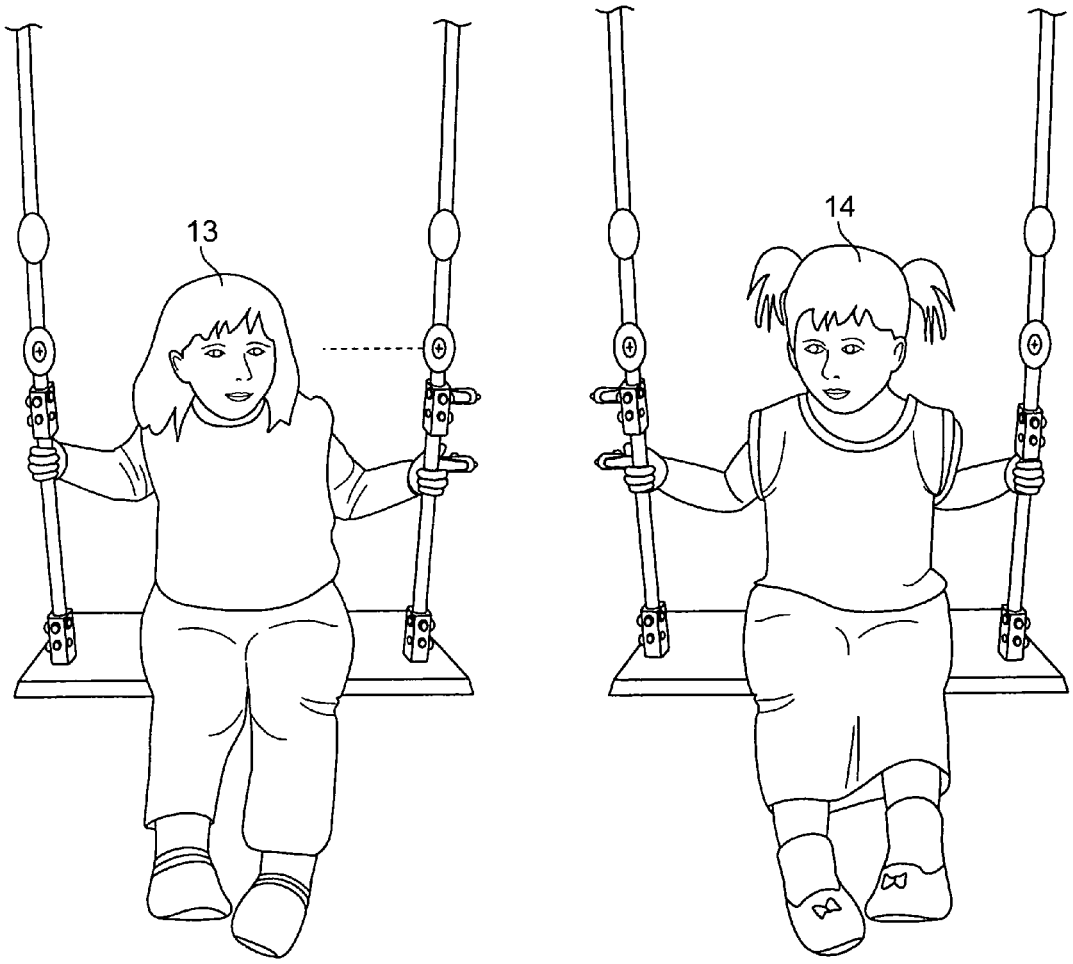
FIG. 1 is a diagram of a first player aiming at a second player.
Figure 2:
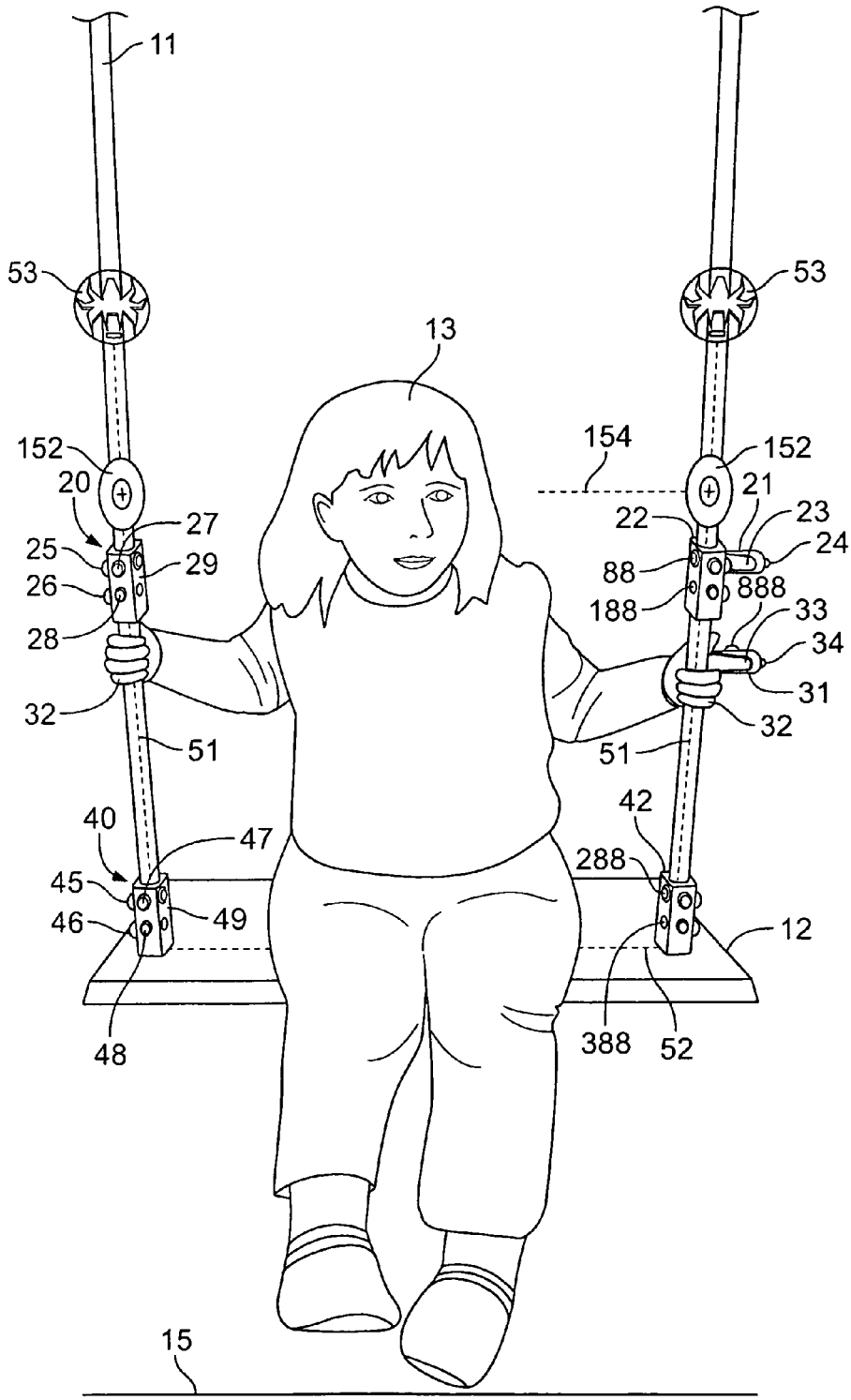
FIG. 2 is a diagram of a first player and equipment related to the first player.

Generally, a swing has a pair of swing supports 11 supported by a seat 12 suspended above the ground 15. FIG. 1 shows a player 13 sitting on the swing seat. The first player can play against a second player 14.

The pair of players can interact with each other by a tag game electronically implemented using one or more modules that emit and receive radiation such as infrared radiation or radio waves. A middle module 20 provides a middle module gun 21 for shooting at the middle module of the other player. The middle module also has a middle module side emitter for shooting at the middle module of the other player. The middle module also has a sleeve cavity 22 that allows in the middle module to fit over and retain to the swing support. The middle module can be made of a plastic injection molded plastic housing or it can be a fabric wrapped around the swing support.

The middle module gun cavity 23 allows the middle module gun to be connected to a middle module side emitter 25. The middle module gun cavity can also fit over a finger of glove 32.

The middle module has a middle module gun emitter 24 and a middle module gun receiver 25. The middle module side receiver 26 receives a wireless signal from the middle module gun emitter 24 or the middle module side emitter 25. The wireless signal can be an infrared beam having a calibrated angle of dispersion such as 5°. The infrared emitter can be low power DC voltage operating on only 5V. The middle module side receiver can be formed as a circular element on an outside surface of the middle module 20.

The middle module is preferably located at approximately arms length from the user in a comfortable position to allow the user hand manipulation of the middle module controls. The middle module controls can be implemented as a middle module first control 27 and a middle module second control 28. The middle module first control 27 and the middle module second control 28 can be formed as buttons or switches. When formed as buttons, the buttons can be mechanical, membrane or capacitance sensing switches. The controls may include assigning the middle module first control as a power switch and assigning the middle module second control as a game reset switch. The controls can also be assigned to so that the reset requires pressing both the middle module first control 27 and the middle module second control 28 buttons simultaneously and holding them down for three seconds. The middle module second control could be used for changing games by cycling through them.

The middle module has a middle module control face 29. The middle module control face allows a player to play the game using player controls. The player controls include at least one attack switch and one defense switch. For example, a middle attack control 88 can be formed as an attack button and a middle defense control 188 can be formed as a defense button. When the attack button is pressed, the user sends an attack input to the game logic processor. When the defense button is pressed, the user sends a defense input to the game logic processor. The functionality of the attack button and the defense button can be varied in a number of ways to implement different types of games.

In the simplest type of tag game, the first player tries to tag the second player, and then the second player tries to tag back the first player. The first player could tag the second player using either the glove gun 31 mounted on the glove 32 by depressing the glove trigger 888 with a finger such as a thumb. The glove gun 31 may include a speaker to provide an audible indicator of the player that is currently 'it'. The glove gun 31 fits over a finger such as an index finger because the glove gun 31 has a finger cavity 33. The finger cavity can be formed as a plastic injection molded member or can also be made as a fabric sleeve having elastic. The first player aims at the second player by pointing the finger having the glove emitter 34. The first player points a finger and then presses the glove trigger 888 to activate the beam. The beam attack may include a sound effect that lasts for a predetermined time such as a second after which the beam attack then becomes inactive for cooldown of a predetermined time such as a second. The middle module side receiver is a target that registers a successful hit which may have a variety of different game effects.

The lower module 40 can be used in conjunction with the middle module, or the middle module can be used by itself. The lower module provides a secondary target as well as a secondary emitter. The lower module may have a similar structure as the middle module. The lower module may include a lower module sleeve cavity 42 for wrapping around and securing to the swing support 11. If the swing support 11 is made of a chain, the lower module sleeve cavity could be an elastic fabric. The lower module may also have a lower module side emitter 45. To allow a user to retain grip on the swing supports, the lower module side emitter 45 can have linked firing with the middle module side emitter 25 such that a user may depress either the middle attack control 88 or the lower attack control 288. Both the lower module attack control 288 and the lower module defense control 388 are preferably mounted to a lower module control face 49.

The lower module preferably includes a lower module first control 47 and the lower module second control 48. The lower module first control 47 can be used for cycling between a linked firing mode and a regular firing mode. The lower module second control 48 could be used for resetting the game. Alternatively, linked firing control could also be controlled by the middle module first or second control.

The lower module controls can also be for game management and therefore switched with the upper module controls so that the controls may include assigning the lower module first control as a power switch and assigning the lower module second control as a game reset switch. The lower module controls can also be assigned to so that the reset requires pressing both the lower module first control and the lower module second control buttons simultaneously and holding them down for three seconds. The lower module second control could be used for changing games by cycling through them.

The finger cavity 33 of the glove gun does not necessarily envelop the finger and the finger cavity 33 can be made in a semi-open configuration with a top extension and lower extension similar to a finger splint. A top extension and lower extension can be connected to and sandwiched around a finger by being connected to the glove, or by an elastic strap or by multiple means.

An electronic circuit central processing unit such as a processor or electronic circuit can provide game resolution. First player inputs 101 and second player inputs 201 most commonly provide for a first player attack 102 and a first player defense 103. A processor can receive first player inputs 101 as well as second player inputs 201. The second player inputs also include a second player attack 202 and a second player defense 203. The player inputs are received by an attack defense resolution processing unit 301 which produces an indication output 400 which can control a variety of visual and audio indicators such as lights 401, speakers 402, vibration 403, or output of a game score 404.

Figure 3:
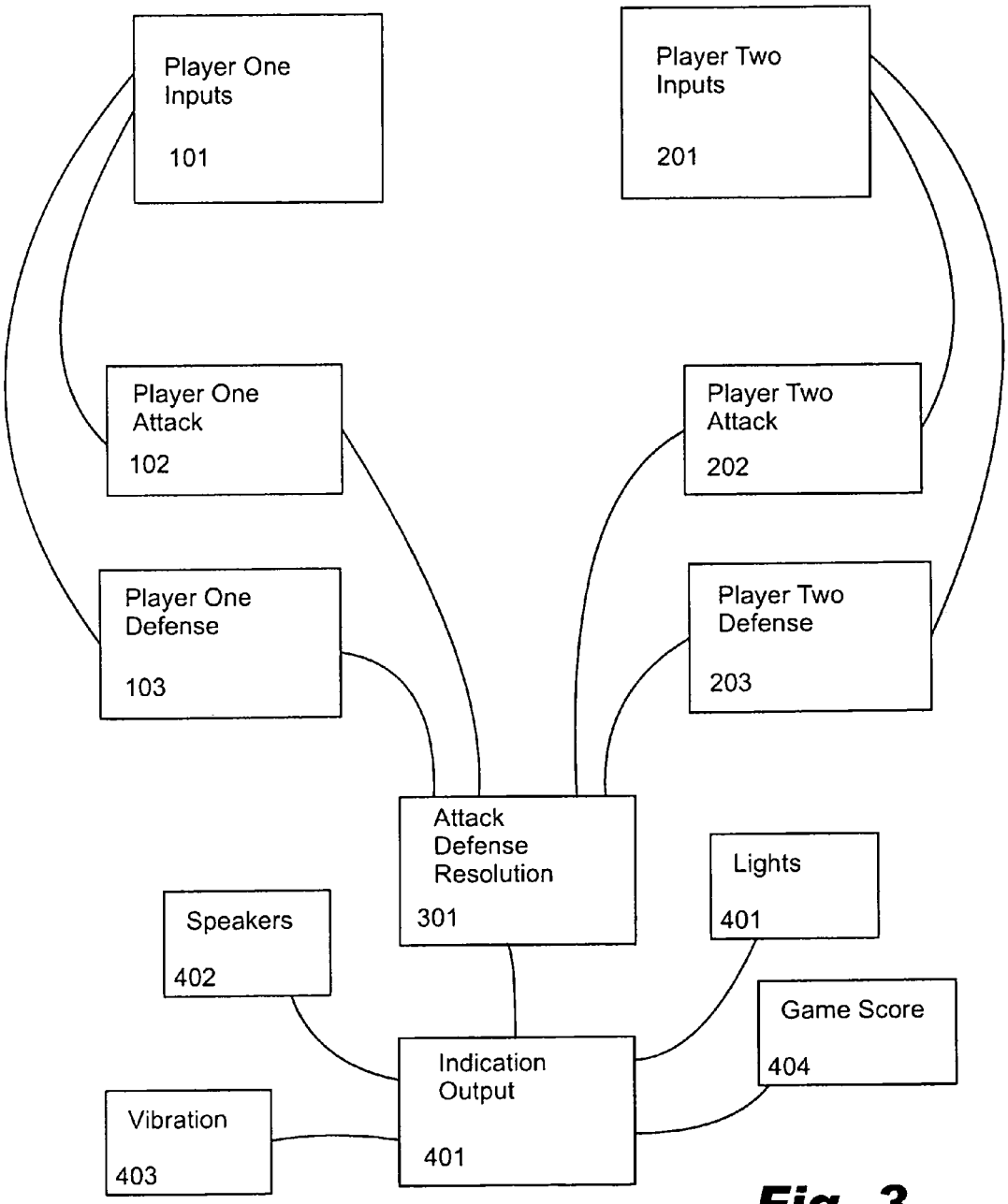
FIG. 3 is a flow chart of input and output processing for the processor.

A processor can be configured to provide a variety of different attack and defense combinations. A circuit acting as a processor can provide an attack defense resolution. In the simplest form, the attack defense resolution has no defense except for when the attack physically misses the receiver. The simplest form provides only for an attack with no in game defense beyond that of physical dodging. More complicated defenses can be devised by providing an in game defense. A variety of different defenses can be used. For example, as shown in FIG. 3, the defense button can be used for alternating between defense modes, namely a rock 311 mode, a paper 312 mode, a scissors 313 mode. Rock beats scissors which beats paper which beats the rock. When three defense modes are being used, a user can switch between the different modes by cycling through them. A user can press the defense button to switch from a rock mode to a scissors mode for example. When they first player defense mode is in paper mode, the first player can be attacked by the second player if the second player is a scissors mode. If the second player is in rock mode, the first player can attack the second player, but the second player cannot attack the first player. The three defense modes are a classic example of dynamic balance but not equivalent defense stances. Players can be assigned different values of attack depending upon their defense mode. For example, a player in rock mode can be given a longer beam activation firing with a longer cool down. Also, minimum time for changing between the different modes can be set to a limit of a predetermined time such as 10 seconds before the defense change mode button is active again. Players can optionally be allowed to attack while in the same mode or not attack while in the same mode.

Figure 4:
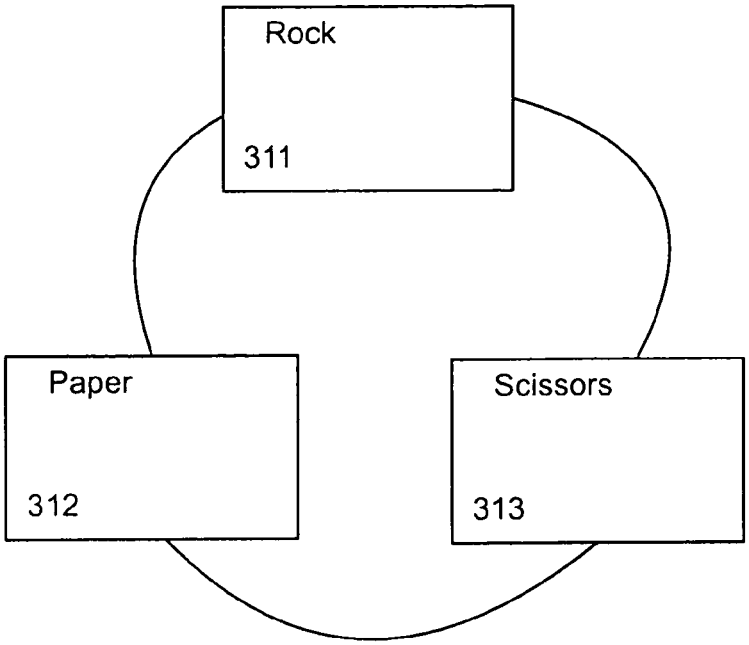
FIG. 4 is a diagram of a rock paper scissors game structure.
Figure 5:
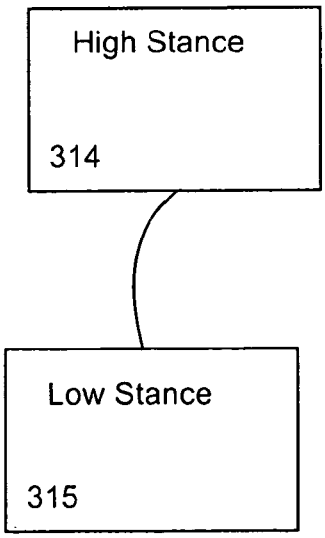
FIG. 5 is a diagram of a high and low stance defense game structure.
Figure 6:
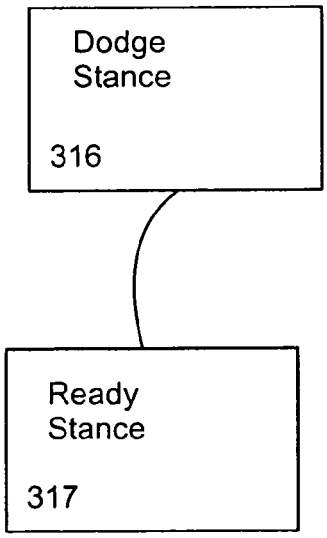
FIG. 6 is a diagram of a dodge and ready stance defense game structure.
Figure 7:
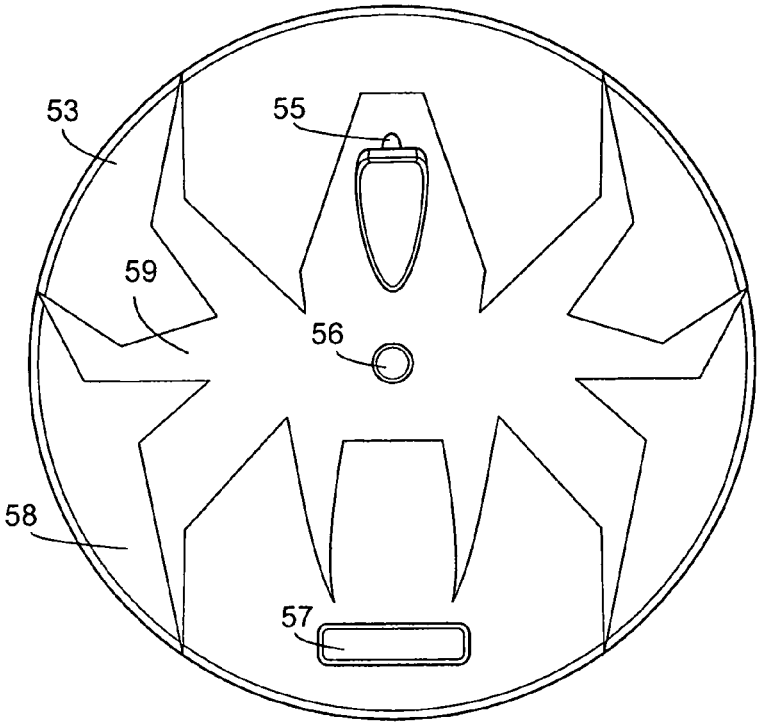
FIG. 7 is a diagram of a game target.
Figure 8:
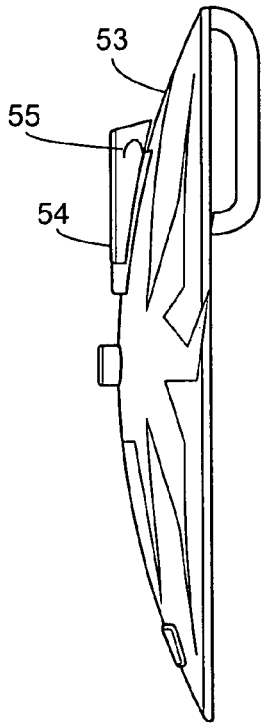
FIG. 8 is a side view of the supplemental game target.

In another configuration of the processor for attack and defense combinations, a high and low stance structure as seen in FIG. 4 can be adopted. The high and low stance can be implemented in two ways. A first way is to require the same stance for attack. For example, a high stance 314 is a first defense mode that is different than a low stance 315 which is set in defense mode. A player in a high stance 314 can attack another player in a high stance, and a player in a low stance can attack another player in a low stance. A player in a high stance cannot attack another player in a low stance and a player in a low stance cannot attack another player in a high stance. The requirement of being in the same stance for attack may be reflected in activating the modules.

A second way to implement a high and low stance defense configuration is to allow the user to toggle the defensive stance using the defense button on the middle module. In a high stance configuration, the player is only vulnerable on the middle module side receiver, and in a low stance configuration, the player is only vulnerable on the lower module side receiver. The lower module side receiver 46 and the middle module side receiver 26 can both have an LED light 401 mounted to it so that it lights when vulnerable and flashes when hit. Also, the lower module side emitter 45 and the middle module side emitter 25 can both have speakers 402 mounted to them so that they make a sound when firing or when the receivers are hit.

In another configuration of the processor for a tax and defense combinations, a dodge stance 316 can be distinguished from a ready stance 317. The dodge stance 316 may be a temporary state that is activated when the first or second player presses the defense button. The pressing of the defense button can put the player into a dodge stance where the player cannot attack, but that player is also not vulnerable for a set amount of time such as 3 seconds. The dodge capability can be available for a set amount of time such as every 20 seconds. This allows players to dodge without physically moving their torso or the balance of the swing.

The different features from the three different configurations for the processor for attack and defense combinations can be combined such as providing a dodge stance for two seconds 316 after a user changes from rock mode 311 to scissors mode 313.

The swing set can also include a reticle 152 to assist in aiming at an opponent. The reticle can be mounted to the swing set support or otherwise connected so that a line of sight 154 is provided to the targeting user. The reticle can be height adjusted by moving up and down the swing set support. The reticle can be adjusted upwards or downwards also to allow targeting of an upper module game target. The upper module game target can be a target instead of the middle module. The upper module game target 53 may further include an upper module receiver shield 54 that can be moved upward or downward depending upon the connection required. The upper module game target 53 may also include a clip. The upper module game target receiver shield 53 can be fully transparent or partially transparent to the infrared beam. The upper module receiver shield can be moved up or down to provide a handicap for a taller player when aiming at the upper module receiver 55. The upper module further includes an upper module light 56 for indicating a successful hit. The upper module also has an upper module display indicator 57 that can display a score or game status. Preferably, the upper module light 56 flashes when hit. The upper module display indicator 57 can also be lighted or partially lighted by the upper module light 56. The upper module preferably includes an upper module translucent layer 59 that partially lights up when the upper module light 56 lights up. The upper module translucent layer is preferably in the shape of a target which can be in the shape of a spider or insect so that it has good contrast against the upper module opaque layer 58.

Figure 9:
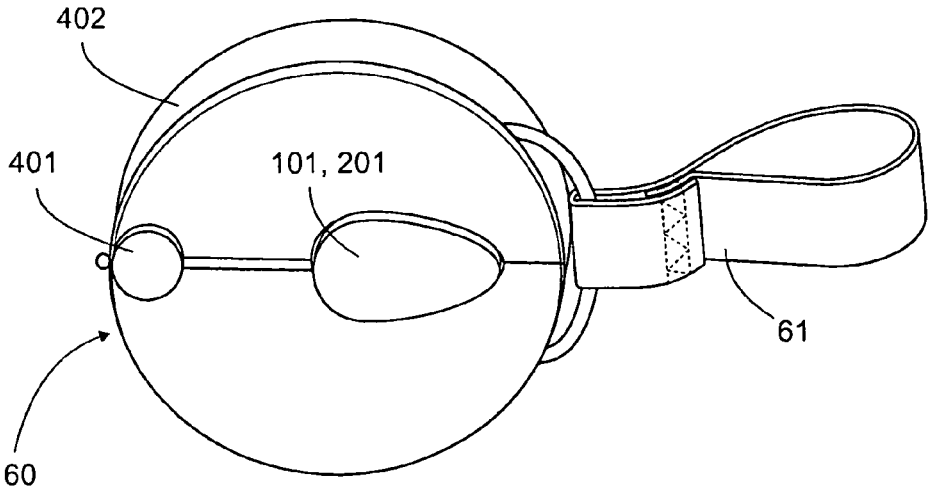
FIG. 9 is an alternate embodiment of a glove gun having a soft wrist strap and rounded body with a button activator and mounted speaker with light.

FIG. 9 is an alternate embodiment of a glove gun having an orb body 60 with soft wrist strap 61 and a button activator for user input 101, 201 and mounted speaker 402 with light 401.

While the presently preferred form of the system has been shown and described, and several modifications discussed, persons skilled in this art will readily appreciate that various additional changes and modifications may be made without departing from the spirit of the invention, as defined and differentiated by the following claims. For example, the game could include experience points where with more stored experience a player is allowed to advance in level to upgrade their shooting device with more capabilities.

The invention claimed is:

1. A swing tag game apparatus comprising:

a. a first swing support supporting a first seat for a first player;

b. a middle module comprising a middle module emitter and a middle module receiver, wherein the middle module is attached to the first swing support;

c. a first player middle module first control located on the middle module, wherein the first player middle module control is configured to receive first player inputs, and wherein the first player inputs is including a first player middle module first control corresponding to an attack;

d. a second swing support supporting a second seat for a second player;

e. a second player middle module first control, wherein the second player middle module control is configured to receive second player inputs including a second player middle module first control corresponding to an attack;

f. an attack defense resolution;

g. an indication output located on the swing tag game apparatus.

2. The swing tag game apparatus of claim 1, wherein the middle module is formed as a glove gun.

3. The swing tag game apparatus of claim 1, wherein the middle module is formed as a sleeve for indicating a successful hit.

4. The swing tag game apparatus of claim 1, wherein the indication output includes a light and sound.

5. The swing tag game apparatus of claim 1, wherein the indication output includes a game score.

6. The swing tag game apparatus of claim 1, further comprising: an upper module with an upper module light for indicating a successful hit.

7. The swing tag game apparatus of claim 1, further comprising: a reticle connected to the first swing support for providing a line of sight for aiming.

8. The swing tag game apparatus of claim 1, further comprising: a lower module which has a lower module receiver.

9. The swing tag game apparatus of claim 1, further comprising: a lower module light for indicating a successful hit.

10. The swing tag game apparatus of claim 1, further comprising a middle module second control.

11. The swing tag game apparatus of claim 1, wherein the middle module is secured to the first swing support.

12. The swing tag game apparatus of claim 11, wherein the middle module is formed as a glove gun.

13. The swing tag game apparatus of claim 11, wherein the middle module is formed as a sleeve for indicating a successful hit.

14. The swing tag game apparatus of claim 11, wherein the indication output includes a light and sound.

15. The swing tag game apparatus of claim 11, wherein the indication output includes a game score.

16. The swing tag game apparatus of claim 11, further comprising: an upper module light for providing an additional target.

17. The swing tag game apparatus of claim 11, further comprising: a reticle connected to the first swing support for providing a line of sight for aiming.

18. The swing tag game apparatus of claim 11, further comprising a second swing support supporting a second seat; and player two inputs.

19. The swing tag game apparatus of claim 11, wherein the middle module is formed as a glove gun, wherein the indication output includes a light and sound, wherein the indication output includes a game score and further comprising: an upper module light for providing an additional target.

* * * * *